US011682822B1

(12) United States Patent
Johnson et al.

(10) Patent No.: US 11,682,822 B1
(45) Date of Patent: Jun. 20, 2023

(54) COLLAPSIBLE DIRECTION FINDING ANTENNA ARRAY FOR SPACE-DISADVANTAGED CYLINDRICAL PLATFORMS

(71) Applicant: BAE Systems Information and Electronic Systems Inc., Nashua, NH (US)

(72) Inventors: Alexander D. Johnson, Waltham, MA (US); James F. Fung, Manchester, NH (US); William K. Grefe, San Diego, CA (US)

(73) Assignee: BAE Systems Information and Electronic Systems Integration Inc., Nashua, NH (US)

( * ) Notice: Subject to any disclaimer, the term of this patent is extended or adjusted under 35 U.S.C. 154(b) by 0 days.

(21) Appl. No.: 17/644,934

(22) Filed: Dec. 17, 2021

(51) Int. Cl.

| | |
|---|---|
| ***H01Q 3/01*** | (2006.01) |
| ***H01Q 1/08*** | (2006.01) |
| ***H01Q 1/30*** | (2006.01) |
| ***H01Q 13/10*** | (2006.01) |

(52) U.S. Cl.
CPC ..... *H01Q 1/08* (2013.01); *H01Q 1/30* (2013.01); *H01Q 13/10* (2013.01)

(58) Field of Classification Search
CPC ..... H01Q 9/0414; H01Q 9/26; H01Q 9/42; H01Q 11/04; H01Q 11/14; H01Q 13/16; H01Q 13/10; H01Q 1/08; H01Q 1/30; H01Q 3/01
See application file for complete search history.

(56) References Cited

U.S. PATENT DOCUMENTS

| | | | | |
|---|---|---|---|---|
| 3,248,735 | A | 4/1966 | Bartolini | |
| 3,568,201 | A | 3/1971 | Spoonamore et al. | |
| 3,715,668 | A * | 2/1973 | Herring | H04B 1/034 455/96 |
| 5,646,366 | A | 7/1997 | O'Connell | |
| 6,392,606 | B1 | 5/2002 | French et al. | |
| 6,476,773 | B2 | 11/2002 | Palmer et al. | |
| 8,418,642 | B2 * | 4/2013 | Vosburgh | F42B 12/365 114/328 |
| 8,443,750 | B2 | 5/2013 | Wiggins et al. | |

(Continued)

FOREIGN PATENT DOCUMENTS

| | | | |
|---|---|---|---|
| IN | 201911009425 | 3/2019 | |
| WO | 2016179600 | 11/2016 | |
| WO | WO-2020031049 A1 * | 2/2020 | H01Q 1/08 |

OTHER PUBLICATIONS

Duploy wt al., Reconfigurable Grounded Vector Antenna for 3-D Electromagnetic Direction-Finding Applications, IEEE Antennas and Wireless Propagation Letters, vol. 17, No. 2, Feb. 2018.

(Continued)

*Primary Examiner* — Awat M Salih
(74) *Attorney, Agent, or Firm* — KPIP Law, PLLC; Gary McFaline

(57) ABSTRACT

The system for a collapsible direction finding antenna. The antenna comprising a rigid central portion and a plurality of foldable arms. The antenna is aerial/kite lifted once launched from a tube to provide increased line of sight above a surface. The antennas being launchable from a UUV, a user in the field, and the like. The antenna being a full azimuth direction finding antenna. In some cases, operating at a wide matched frequency of 1 to 6 GHz.

6 Claims, 4 Drawing Sheets

(56) References Cited

U.S. PATENT DOCUMENTS

| | | | | |
|---|---|---|---|---|
| 8,813,669 | B2 | 8/2014 | Race et al. | |
| 10,773,780 | B2 * | 9/2020 | Smith | B63G 8/001 |
| 10,811,777 | B1 * | 10/2020 | Fuchi | H01Q 3/01 |
| 2002/0024468 | A1 | 2/2002 | Palmer et al. | |
| 2008/0192576 | A1 * | 8/2008 | Vosburgh | H01Q 1/04 367/134 |
| 2011/0304508 | A1 | 12/2011 | Remez et al. | |
| 2012/0118213 | A1 | 5/2012 | Wiggins et al. | |
| 2013/0063321 | A1 | 3/2013 | Ruvinsky et al. | |
| 2014/0340275 | A1 * | 11/2014 | Georgakopoulos | H01Q 1/36 343/834 |
| 2015/0375840 | A1 | 12/2015 | Stowers | |
| 2017/0269188 | A1 * | 9/2017 | Harne | G10K 11/32 |
| 2018/0072014 | A1 * | 3/2018 | Dudte | B31D 5/04 |
| 2018/0134357 | A1 | 5/2018 | Vestel et al. | |
| 2020/0373673 | A1 | 11/2020 | Hashemi et al. | |
| 2021/0313668 | A1 * | 10/2021 | Freebury | H01Q 1/1264 |
| 2021/0376484 | A1 | 12/2021 | Elsallal et al. | |

OTHER PUBLICATIONS

Duploy et al., Wideband and Reconfigurable Vector Antenna Using Radiation Pattern Diversity for 3-D Direction-of-Arrival Estimation, IEEE Transactions on Antennas and Propagation, vol. 67, No. 6, Jun. 2019.

Duploy et al., Wideband Vector Antenna for Dual-Polarized and Three-Dimensional Direction-Finding Applications, IEEE Antennas and Wireless Propagation Letters, vol. 18, No. 8, Aug. 2019.

Johan Duplouy. Wideband Reconfigurable Vector Antenna for 3-D Direction Finding Application. Electromagnetism. Institut National Polytechnique de Toulouse—INPT, 2019. English. ffNNT : 2019INPT0002ff.

International Search Report, PCT/US22/52953, dated Apr. 5, 2023, 13 pages.

* cited by examiner

COLLAPSIBLE DIRECTION FINDING ANTENNA ARRAY FOR SPACE-DISADVANTAGED CYLINDRICAL PLATFORMS

FIELD OF THE DISCLOSURE

The present disclosure relates to antennas and more particularly to collapsible direction finding antennas for use on space-disadvantaged cylindrical platforms, i.e. unmanned underwater vehicles.

BACKGROUND OF THE DISCLOSURE

Small form factor (<12" diameter) unmanned underwater vehicles (UUV) are a great asset to the Navy's underwater arsenal. These UUV can serve a number of communications, intelligence, surveillance, and reconnaissance (ISR), and sensing functions in either optical, acoustic, or radio frequency (RF) domains. It is known that UUV are used for carrying out naval missions. These UUV are often deployed from a larger submarine's torpedo tubes that dictate the UUV's shape. Often this requires a tube of constant diameter, with minimal radial projections from the hull of the UUV.

However to be useful in the RF domain, any communication antenna utilized must be at an extended distance above the sea surface to avoid interference and to obtain adequate signal strength. To maintain volume requirements, current solutions rely on low profile 'shark fins', surface buoys towed behind the UUV, or extendable periscopes that only protrude a few feet above the water. In order to extend line of sight (LOS) radio links, an antenna must be operated at greater heights above the water (e.g., 10+ feet).

Previous systems show the existence of large kite/aerial/balloon carried antenna, though neither overcome the above-mentioned shortcomings and drawbacks associated with the conventional antennas for use on space-disadvantaged cylindrical unmanned underwater vehicles. Namely, the ability to be stored in a small cylindrical volume and retain physical memory to operate at full efficiency after deployment has not been addressed for DF antenna apertures.

Wherefore it is an object of the present disclosure to overcome the above-mentioned shortcomings and drawbacks associated with the conventional antennas for use on small cylindrical platforms like unmanned underwater vehicles.

SUMMARY OF THE DISCLOSURE

One aspect of the present disclosure is an antenna assembly, comprising: a rigid central feed portion; and a plurality of arms engaged with the rigid central feed portion, wherein the plurality of arms comprise a flexible substrate and a metallization layer for forming a full azimuth direction finding antenna array.

One embodiment of the antenna assembly is wherein the flexible substrate comprises a polyimide layer with metallization forming tapered slot antenna elements, the flexible substrate is sliced into multiple independently-foldable sections, and where each slice extends from the outer radius of the antenna assembly inward to the outer radius of the central feed.

Another embodiment of the antenna assembly is wherein the rigid central feed portion comprises four RF connectors mounted to the central feed's four printed copper slot balun feed circuits.

Another embodiment of the antenna assembly is wherein the four printed copper slot balun feed circuits inject radio frequency signals to the four tapered slot antenna elements printed upon the flexible substrate sections.

Another aspect of the present disclosure is an antenna assembly, comprising: a rigid central feed portion configured to attach to a tether; and a plurality of arms engaged with the rigid central feed portion, wherein the plurality of arms comprise a flexible substrate and a metallization layer for forming a full azimuth direction finding antenna array that may be folded to fit within a cylindrical platform.

One embodiment of the antenna assembly is wherein the diameter of the rigid central feed board portion is smaller than the inner diameter of a cylindrical platform.

Another embodiment of the antenna assembly is wherein the full azimuth direction finding antenna is deployed from a UUV platform.

Yet another embodiment of the antenna assembly is wherein the full azimuth direction finding antenna is deployed from a cylindrical platform by a user in the field.

Yet another embodiment of the antenna assembly is wherein the full azimuth direction finding antenna is deployed from a cylindrical platform by a upward drag force along its tether, with such a force created by an aerial (kite, UAV, balloon, and all other known to art).

Yet another aspect of the present disclosure is an antenna assembly, comprising: a rigid central feed portion configured to attach to a tether for an aerial; a plurality of arms engaged with the rigid central feed portion, wherein the plurality of arms comprise a flexible substrate and a metallization layer forming a full azimuth direction finding antenna array when in a planar orientation outside of the cylindrical platform; and where the full azimuth direction finding antenna array's flexible substrate layers are folded within the cylindrical platform before use.

These aspects of the disclosure are not meant to be exclusive and other features, aspects, and advantages of the present disclosure will be readily apparent to those of ordinary skill in the art when read in conjunction with the following description, appended claims, and accompanying drawings.

DETAILED DESCRIPTION OF THE DISCLOSURE

In this disclosure the problem of limited line of sight communication capabilities for UUVs is solved using aerial/kite lifted antennas. The aerial/kite lifted antenna solution of the present disclosure has greater performance than existing UUV antenna deployment styles as it significantly extends the radio line of sight link budget by a factor of the sqrt(h), where h is the antenna's height off the water. For example, a 5 ft fin antenna that covers a 20 mi radius can be replaced by an aerial/kite lifted antenna 20 ft in the air that covers a 40 mi radius, applying the assumption that these are antennas of equal gain. The antenna of the present disclosure also has the extremely low size and weight requirements needed for a micro-UUV (UUV with inner diameter as low as 3 inches). It is to be understood that this approach can be scaled or implemented in larger UUV formats as well.

The aerial/kite lifted antenna solution of the present disclosure has a small form factor well-suited for use with UUVs. Other aerial antennas have been used for communication vehicles, but these antennas are large, rigid, and unscalable to a micro-UUV, for example. One embodiment of the antennas of the present disclosure deploy from a 3" diameter UUV using series line drag.

The collapsible direction finding antenna solution of the present disclosure has a small form factor well-suited for use with UUV. Previous direction finding antennas have been implemented with rigid substrates, with the need for specific spacings, and/or with the requirement of computational processing to find the angle of arrival. One embodiment of the present disclosure is a flexible amplitude-only direction finding antenna that can deploy from a tube platform as small as 3" in diameter using a series line drag tether from an aerial in flight above. In one embodiment, a digital compass capable of angular positioning can provide a reference angle to the incoming direction finding measurement.

Figure 1:
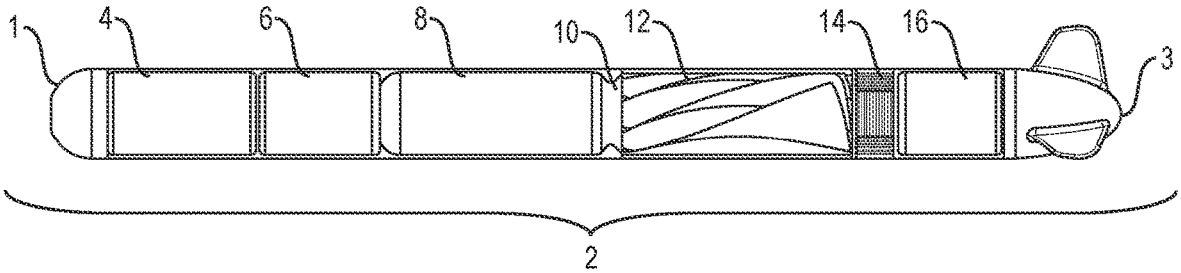
FIG. 1 is a diagram of one embodiment of a collapsible direction finding antenna according to the principles of the present disclosure within an unmanned underwater vehicle.

Referring to FIG. 1, a diagram of one embodiment of a collapsible direction finding antenna according to the principles of the present disclosure within an unmanned underwater vehicle is shown. More specifically, one embodiment of an unmanned underwater vehicle (UUV) 2 of the present disclosure comprises, moving in a direction from the nose 1 to the tail 3, a surface float 4, a kite launcher 6 (e.g., compressed air, explosive charge, etc.), a spool 10 for holding a tether 9, a folded aerial/kite 8, or the like, an antenna 12, several meters of cable 14, and an software defined radio (SDR) transceiver 16, or the like. The UUV 2 in one example is configured to be launched from a tube of a vessel, submarine or larger UUV. In another example the UUV 2 is launched from an air-borne vehicle into the water.

Figure 2A:
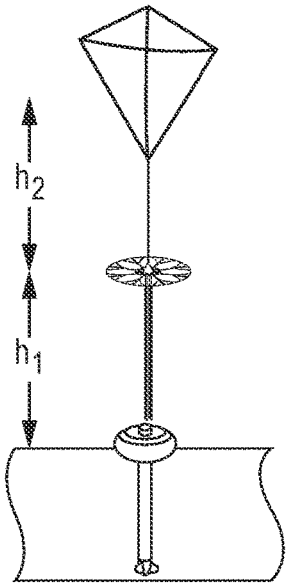
FIG. 2A and FIG. 2B show one embodiment of a collapsible direction finding antenna according to the principles of the present disclosure in the process of launching from an unmanned underwater vehicle.
Figure 2B:
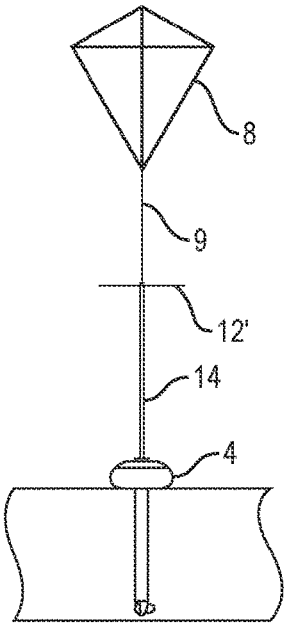

Referring to FIG. 2A and FIG. 2B, one embodiment of a collapsible direction finding antenna according to the principles of the present disclosure in the process of launching from an unmanned underwater vehicle is shown. For example, the UUV 2 is launched into the water such as from a submarine or larger UUV, and is triggered to deploy. The trigger can be upon impact, a certain depth setting, timer, electric signal and the like. In one example the kite launcher is a small explosive charge that detonates when triggered and rapidly deploys the kite, antenna and tethers along with the float that positions the UUV 2 approximately vertical with the fins downward of the nose. As the kite 8 rises upward, it pulls the tether 9 to a certain height $h_2$ above the antenna 12' with the tether 9 affixed to the antenna 12. The cable(s) 14 extend from the inside of the UUV 2 to the antenna 12 with a height $h_1$. In one embodiment the kite is inflated with a gas lighter than air to help propel the kite upwards More specifically, in FIG. 2A, the UUV 2 has deployed a surface float 4 and a kite 8 (or other aerial lift) has launched with the foldable antenna assembly 12' fully deployed. In one embodiment, $h_1$ is about 3-10 m and $h_2$ is about 3 m. In FIG. 2B, the aerial/kite 8 and the planar extended antenna assembly 12' are fully deployed and the UUV is suspended nose up in the water via a deployed surface float 4.

Figure 3:
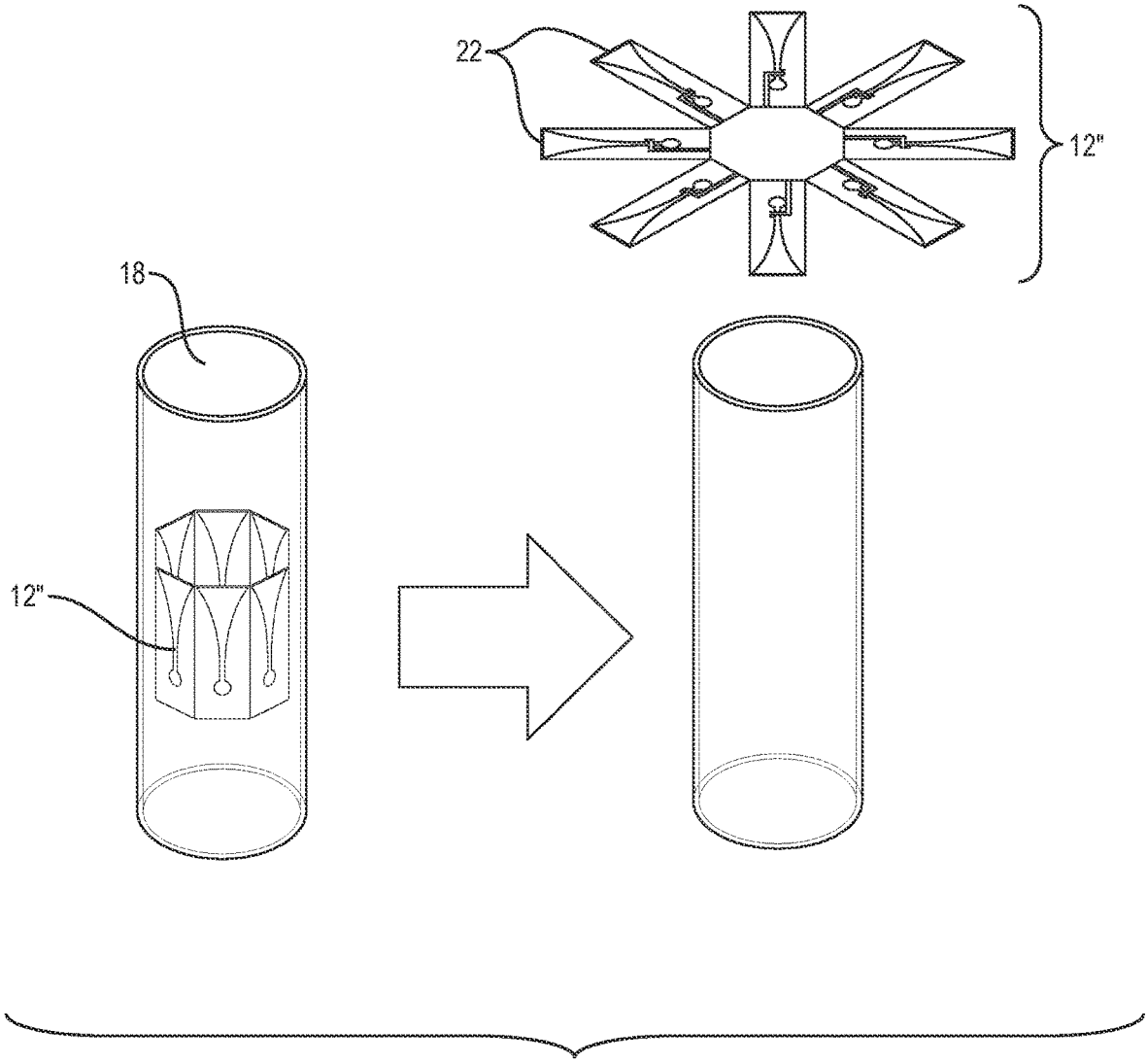
FIG. 3 is a diagram showing how one embodiment of a collapsible direction finding antenna is stored within a tube and expands when launched according to the principles of the present disclosure.

Referring to FIG. 3, a diagram showing how another embodiment of a collapsible direction finding antenna 12" is stored folded within a tube 18 and expands to a planar orientation when launched according to the principles of the present disclosure is shown. More specifically, an antenna assembly according to the principles of the present disclosure is configured to be folded such that it can be stored in and launched from a tube 18. In certain embodiments, the antenna assembly 12" is made of a flexible substrate that allows it to be folded and tube-deployed and comprises a plurality of arms 22.

In one embodiment of a collapsible direction finding antenna according to the principles of the present disclosure, a polyimide film substrate is used with copper tape metallization to form an antenna assembly capable of being stored in about a 3" tube. In another embodiment, rigid printed circuit board substrates are used for the central feed circle of radius <3". In one case, a composite material composed of woven fiberglass cloth with an epoxy resin binder was used as a substrate. In still other embodiments, woven glass reinforced hydrocarbon/ceramics were used. In certain embodiments, the antenna assembly is 'soft' hinge deployed. In one embodiment, the antenna assembly is a full azimuth direction finding (DF) antenna operating over a wide matched frequency band of 1-6 GHz.

Figure 4A:
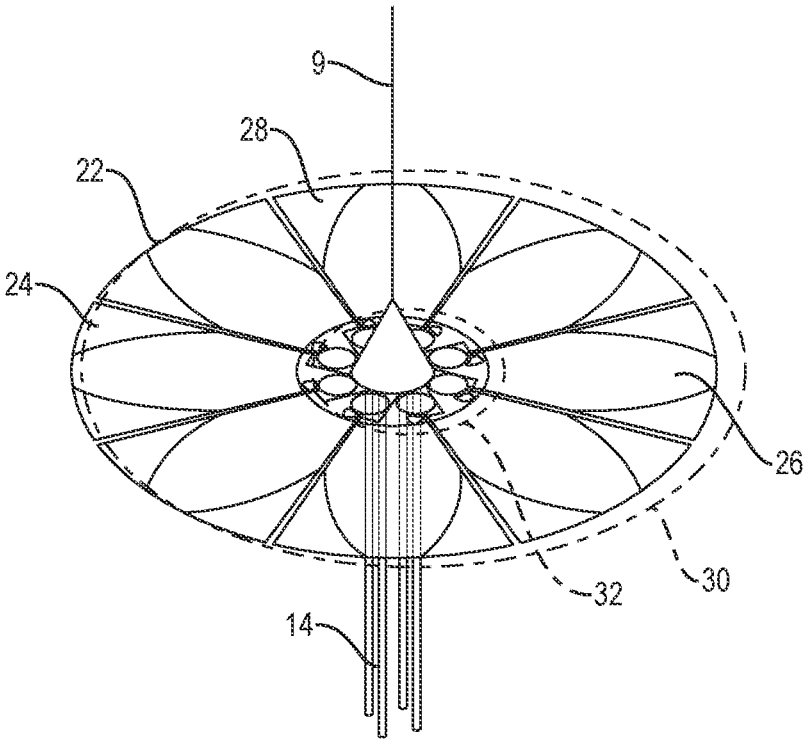
FIG. 4A is a diagram of one embodiment of a collapsible direction finding antenna according to the principles of the present disclosure.

Referring to FIG. 4A, a diagram of one embodiment of a collapsible direction finding antenna according to the principles of the present disclosure is shown. More specifically, the planar, foldable antenna assembly is formed on a flexible substrate 24 having a metallization layer on top 26. In one embodiment the substrate is 5 mil polyimide and the metallization layer is 0.6 mil copper tape tapered slots. A plurality of slits 28 are present periodically around the perimeter of the substrate to provide for folding of the arms 22 of the antenna such that the arms 22 are effectively hinged at the perimeter of the central portion 32. In one embodiment, each arm 22 is foldable independent of any remaining arms. In one embodiment of the fully extended, planar antenna assembly 12', the outer diameter of the antenna assembly 30 is about 8 in and the outer diameter of a central portion 32 is less than 3 in so that the folded antenna can fit in a 3 in tube for storage.

In one embodiment, four RF connectors are used to connect cabling 14 to four antennas in the antenna assembly. As illustrated in this example, there are four cables 14 electrically coupling the antenna to the transceiver 16. A tether 9 for a kite (or other aerial lift) is also shown. In one embodiment, the arms 22 are shaped like petals. In one embodiment there are eight arms making up four antennas with cables connecting to each antenna. In one embodiment, two petals next to each other (e.g. sections with 26 and 30) act as one antenna and four of these pairs make eight petals for 360° azimuth coverage. In some cases, the diameter of the antenna assembly, when deployed, is about 9 in. In certain embodiments, the tube diameter is about 3 in.

Figure 4B:
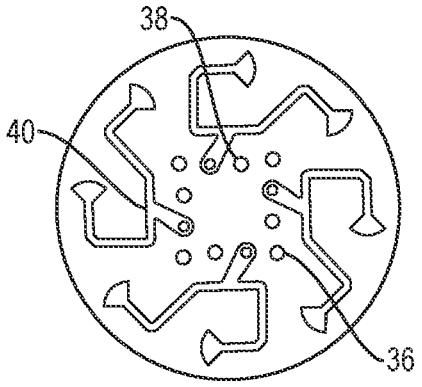
FIG. 4B is a diagram of one portion of one embodiment of a collapsible direction finding antenna according to the principles of the present disclosure.

Referring to FIG. 4B, a diagram of one portion of one embodiment of a collapsible direction finding antenna according to the principles of the present disclosure is shown. More specifically, the central portion in this embodiment of the collapsible direction finding antenna is a rigid printed circuit board (PCB) having four standard RF connectors 36 and nylon screws 38 (or other fasteners) used to secure the antenna. In certain embodiments, a plurality of feeds 40 are printed on a composite substrate. In one embodiment, four feeds are copper printed on a 0.020" PCB support layer.

Figure 5:
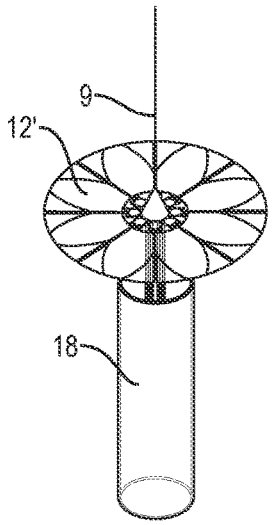
FIG. 5 shows one embodiment of a collapsible direction finding antenna according to the principles of the present disclosure in the process of being stored in a tube.

Referring to FIG. 5, one embodiment of a collapsible direction finding antenna according to the principles of the present disclosure in the process of being launched from a tube is shown. More specifically, a 3" inner diameter tube 18 is shown as the foldable antenna assembly 12' is lifted out of the tube 18 via a tether 9. In other embodiments, the antenna can be pneumatically launched from the tube, spring launched from the tube, or launched from the tube via any method known to the art.

Referring to FIG. 6*a-e*, one embodiment a collapsible direction finding antenna according to the principles of the present disclosure is shown in a series of views during assembly. More specifically, in FIG. 6*a* one embodiment of the fully extended antenna assembly, from the printed PCB side, is shown having an outer diameter of the antenna assembly of about 9" and an outer diameter of a central PCB portion of less than 3" is shown.

Figure 6:
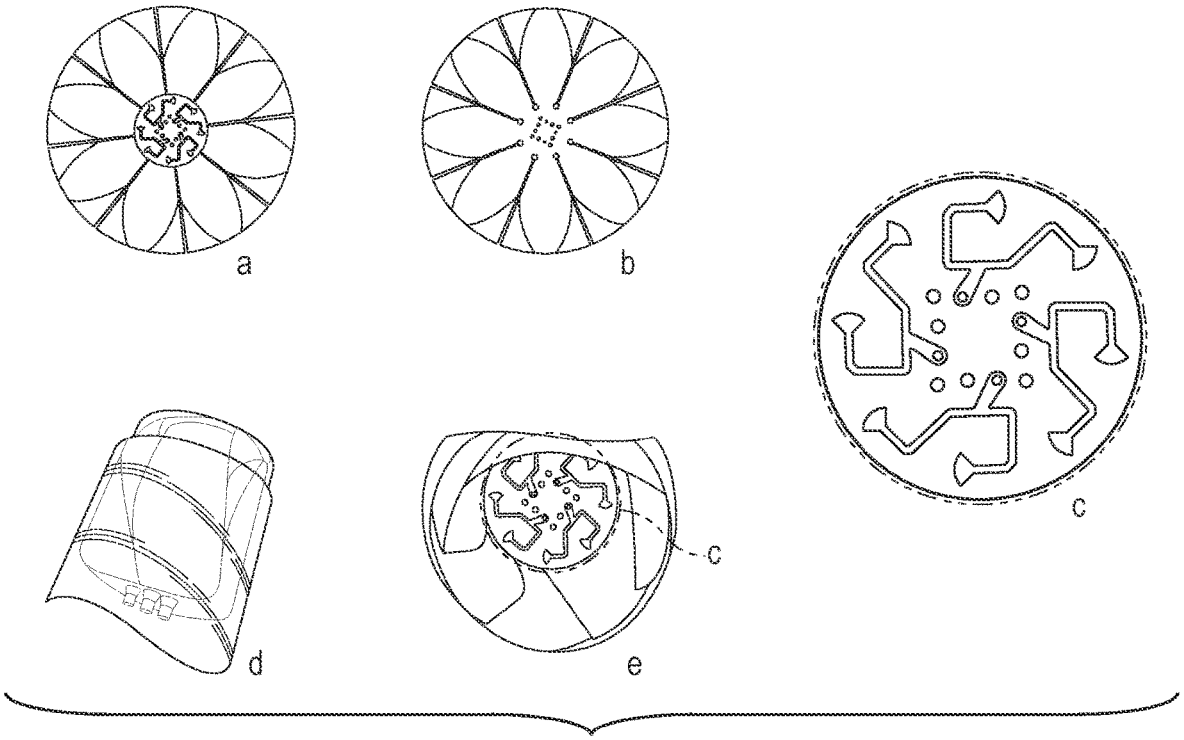
FIG. 6 shows one embodiment of a collapsible direction finding antenna according to the principles of the present disclosure in a series of views during assembly.

In FIG. 6*b*, the fully extended antenna assembly, from RF connector side with RF connectors present, is shown having a metallization layer comprising copper tape tapered slots is shown. In FIG. 6*c*, one embodiment of a rigid printed circuit board central portion is shown with four feeds and holes for securing the central portion to the arms. In FIG. 6*d*, shows the antenna assembly in the tube looking from the outside through the transparent tube, and FIG. 6*e* shows the antenna assembly in the tube looking from the perspective of the tube's opening.

Various inventive concepts may be embodied as one or more methods, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

While various inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

The articles "a" and "an," as used herein in the specification and in the claims, unless clearly indicated to the contrary, should be understood to mean "at least one." The phrase "and/or," as used herein in the specification and in the claims (if at all), should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc. As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of" "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

When a feature or element is herein referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present. Although described or shown with respect to one embodiment, the features and elements so described or shown can apply to other embodiments. It will also be appreciated by those of skill in the art that references to a structure or feature that is disposed "adjacent" another feature may have portions that overlap or underlie the adjacent feature.

Spatially relative terms, such as "under", "below", "lower", "over", "upper", "above", "behind", "in front of", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal", "lateral", "transverse", "longitudinal", and the like are used herein for the purpose of explanation only unless specifically indicated otherwise.

Although the terms "first" and "second" may be used herein to describe various features/elements, these features/elements should not be limited by these terms, unless the context indicates otherwise. These terms may be used to distinguish one feature/element from another feature/element. Thus, a first feature/element discussed herein could be termed a second feature/element, and similarly, a second feature/element discussed herein could be termed a first feature/element without departing from the teachings of the present invention.

An embodiment is an implementation or example of the present disclosure. Reference in the specification to "an embodiment," "one embodiment," "some embodiments," "one particular embodiment," "an exemplary embodiment," or "other embodiments," or the like, means that a particular feature, structure, or characteristic described in connection with the embodiments is included in at least some embodiments, but not necessarily all embodiments, of the invention. The various appearances "an embodiment," "one embodiment," "some embodiments," "one particular embodiment," "an exemplary embodiment," or "other embodiments," or the like, are not necessarily all referring to the same embodiments.

If this specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

As used herein in the specification and claims, including as used in the examples and unless otherwise expressly specified, all numbers may be read as if prefaced by the word "about" or "approximately," even if the term does not expressly appear. The phrase "about" or "approximately" may be used when describing magnitude and/or position to indicate that the value and/or position described is within a reasonable expected range of values and/or positions. For example, a numeric value may have a value that is +/−0.1% of the stated value (or range of values), +/−1% of the stated value (or range of values), +/−2% of the stated value (or range of values), +/−5% of the stated value (or range of values), +/−10% of the stated value (or range of values), etc. Any numerical range recited herein is intended to include all sub-ranges subsumed therein.

Additionally, the method of performing the present disclosure may occur in a sequence different than those described herein. Accordingly, no sequence of the method should be read as a limitation unless explicitly stated. It is recognizable that performing some of the steps of the method in a different order could achieve a similar result.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively, as set forth in the United States Patent Office Manual of Patent Examining Procedures.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of various embodiments of the disclosure are examples and the disclosure is not limited to the exact details shown or described.

While the principles of the disclosure have been described herein, it is to be understood by those skilled in the art that this description is made only by way of example and not as a limitation as to the scope of the disclosure. Other embodiments are contemplated within the scope of the present disclosure in addition to the exemplary embodiments shown and described herein. Modifications and substitutions by one of ordinary skill in the art are considered to be within the scope of the present disclosure.

What is claimed:

1. An antenna assembly, comprising:

a rigid central feed portion configured to attach to a tether for an aerial; and a plurality of arms engaged with the rigid central feed portion, wherein the plurality of arms comprise a flexible substrate and a metallization layer for forming a full azimuth direction finding antenna when in a planar orientation outside of the cylindrical platform; and where the full azimuth direction finding antenna array's flexible substrate layers are folded within the cylindrical platform before use.

2. The antenna assembly according to claim 1, wherein the diameter of the rigid central feed board portion is smaller than the inner diameter of a cylindrical platform.

3. The antenna assembly according to claim 1, wherein the full azimuth direction finding antenna is launched from a UUV.

4. The antenna assembly according to claim 1, wherein the full azimuth direction finding antenna is launched by a user in the field.

5. The antenna assembly according to claim 4, wherein the rigid central feed portion comprises four RF connectors mounted to four printed copper slot balun feeds, and fits within the cylindrical platform in a stored state.

6. The antenna assembly according to claim 1, wherein the full azimuth direction finding antenna is deployed from a cylindrical platform by an upward drag force along its tether, with such a force created by an aerial.

* * * * *